US008627778B2

(12) United States Patent
Wright et al.

(10) Patent No.: US 8,627,778 B2
(45) Date of Patent: Jan. 14, 2014

(54) ELEVATED DOCK

(76) Inventors: Jeff Wright, Wilsonville, OR (US); Tod Wright, Wilsonville, OR (US); Scott Wheatley, Sherwood, OR (US)

( * ) Notice: Subject to any disclaimer, the term of this patent is extended or adjusted under 35 U.S.C. 154(b) by 162 days.

(21) Appl. No.: 12/971,824

(22) Filed: Dec. 17, 2010

(65) Prior Publication Data

US 2011/0146554 A1 Jun. 23, 2011

Related U.S. Application Data

(60) Provisional application No. 61/289,896, filed on Dec. 23, 2009.

(51) Int. Cl.
*B63C 1/02* (2006.01)

(52) U.S. Cl.
USPC ..... 114/45

(58) Field of Classification Search
USPC ..... 114/44, 45, 46, 258, 263; 405/218, 219, 405/220, 221
See application file for complete search history.

(56) References Cited

U.S. PATENT DOCUMENTS 1,825,613 A * 9/1931 Bell ..... 114/61.22
3,054,267 A * 9/1962 Alcorn et al. ..... 405/209
5,664,513 A * 9/1997 Echelbarger ..... 114/45
5,799,916 A * 9/1998 Lechner ..... 248/230.8
6,032,601 A * 3/2000 Gates ..... 114/45
6,131,528 A * 10/2000 Meek et al. ..... 114/44
6,964,239 B2 * 11/2005 Vinnik ..... 114/44
7,021,861 B2 * 4/2006 Basta ..... 405/3
2008/0236467 A1 * 10/2008 Wyman ..... 114/61.1

* cited by examiner

*Primary Examiner* — Stephen Avila
*Assistant Examiner* — Andrew Polay
(74) *Attorney, Agent, or Firm* — Madson IP, P.C.

(57) ABSTRACT

An elevated dock designed to lift boats out of the water when not in use is provided because storing a boat in the water exposes the boat to contaminants in both fresh and salt water. These contaminants attach to the bottom of the boat severely impeding the performance of the boat. Cleaning these contaminants off of the boat is time consuming and costly. Repeated cleaning of the boat will eventually result in damage to the hull. The elevated dock uses polymer to form adjustable pontoons that can easily be fitted to a variety of sizes and styles of boats. An embodiment of the elevated dock uses an articulated set of pontoons for lifting sailboats. The elevated dock can be deployed completely independent of the dock, eliminating unwanted stress to the dock. The unique gusset design, free-floating feature, articulated pontoon option coupled with the unique manner in which the pontoon length, width and volume can be adjusted for various boat types and sizes.

19 Claims, 18 Drawing Sheets

ELEVATED DOCK

RELATED APPLICATION

This application claims the benefit of U.S. Provisional Application No. 61/289,896 filed Dec. 23, 2009 and entitled ELEVATED DOCK, and is incorporated herein by this reference.

TECHNICAL FIELD

The present invention relates generally to boat storage. More specifically, the present invention relates to a safe stable elevated platform out of the water for a boat to reside when not in use.

BACKGROUND

Boats are inherently expensive and require a high degree of maintenance. In the past, boat owners would typically pay a slip fee and simply leave their boat in the water tied to the dock. As a result of this practice, periodic maintenance of the boat was required in the form of cleaning the bottom of the boat. In either fresh or salt water the detrimental effects are pervasive. In fresh water, silt, algae, moss, etc. attack the hull of the boat. In saltwater, barnacles, mussels, seaweed and spilled oil contaminate the hull. If the hull of the boat is not cleaned periodically the performance of the boat is dramatically affected and over time the hull of the boat could be permanently damaged. Even periodic cleaning is hard on the boat given repeated cleanings which can result in fiberglass saturation from high pressure washers.

Additionally, one environmental concern about leaving a boat in the water is that there is the potential that aquatic invasive species can attach to your boat which is detrimental when the boat is then sailed in another body of water resulting in the cross contamination of lakes and streams.

Most if not all of these effects can be eliminated by simply removing the boat from the water while not in use. Traditionally removing a boat from the water means drawing it up a boat-ramp onto a boat trailer. This is not convenient particularly when the boat ramp is not close to where you actively boat.

Also, boats are available in a wide variety of shapes and sizes. It is not practical to remove larger boats from the water after each use. It is especially difficult to remove sailboats from the water because of their large keels. There exist pneumatic boat-lift apparatus available commercially but they all have the disadvantage of requiring a hard connection to a dock. The hard dock connection often results in undue stress and eventual damage to the dock. As a result many marinas do not permit the use of pneumatic boat-lifts.

The only known boat-lifts utilize a steel frame that must be anchored to the dock. The frame is heavy and subject to corrosion from water and salt. The additional weight necessitates larger pontoons. Larger pontoons require more air volume to create the necessary buoyancy to raise the boat out of the water. Traditionally, existing boat-lifts only fit a narrow range of boat sizes and styles. The present invention is formed almost entirely out of polymer so it is not affected by the corrosive nature of water and salt and it is relatively light weight. It is not required to be anchored to the dock and it is adjustable to accommodate various sizes and styles of boats.

Advantages of the elevated dock of the present invention over presently known boat-lifts may include, but are not limited to the following advantages. The support plates for the hull are adjustable. Uniquely designed flat gusset plates may be used to attach the round pontoons together while also incorporating integral tie-downs and service plank mounting positions. Uniquely designed flat gusset plates may restrict the rotation of the rear exhaust ports. Further, the elevated dock is not required to be anchored to a dock. Polymer used to form the majority of the elevated dock is light weight and not subject to corrosion from water and salt. The elevated dock will not sink to the bottom if the air is fully released from the pontoons. The elevated dock has a positive stop notifying the boat operator that the boat is properly positioned for optimal performance of the boat-lift.

The elevated dock is adjustable to fit various boat sizes and styles. The elevated dock does not require skilled labor to install. It is simply assembled and placed into the water. The elevated dock does not require any specialized tools to assemble or adjust. All hardware is attached to the polymer structure by lanyards.

The elevated dock has optional sea anchors or stabilizing baffles (stabilizing plates that extend horizontally or vertically along the length of the pontoons) to ensure a stable platform in rough waters enabling the elevated dock to be used with a mooring buoy in open waters. Another embodiment of the present invention has articulated pontoons for use with sailboats. Embodiments may have a sealed pontoon at the front of the boat-lift that is positioned perpendicular to the side pontoons and may have a rotating attachment to the side pontoons. Also, embodiments of the present invention can accommodate personal watercraft in addition to the boat or be used for multiple personal watercrafts.

The purpose of this innovation is to provide a safe stable elevated platform out of the water for the boat to reside when not in use, thus eliminating the required maintenance described above.

SUMMARY OF THE INVENTION

The present invention employs pontoons (typically in pairs) that can be submerged below the water by removing the internal air, enabling a boat to pass over the top of the pontoons where the pontoons can then be pressurized with air to remove the water thus lifting the boat out of the water. When employed in pairs, one pontoon can be positioned on each side of the boat providing the necessary "balanced lift" to safely elevate the boat out of the water, forming an elevated dock. With the present innovation, it is not necessary to attach the elevated dock to a stationary or permanent dock. It is possible and anticipated that the elevated dock of the present invention could be used in a mooring application.

Since boats come in many weights and sizes it is anticipated that the pontoons will need to be available in various sizes (volumes) to provide adequate lift. They will also need to be adjustable in length and width. This is accomplished by the innovation of telescoping pontoons that make it possible to accommodate various boat sizes and weights. It has been considered that the pontoons might also be articulated to accommodate the keels of sailboats which hang much further down below the waterline than a conventional motor boat hull.

Generally, the present invention is designed to provide a stable, floating, elevated boat support which can be raised and lowered, in and out of the water by means of a pneumatic pump. The innovative design permits the elevated dock to be completely independent of the dock, eliminating unwanted stress to the dock. The unique gusset design, free-floating feature, articulated pontoon option coupled with the unique manner in which the pontoon length, width and volume can be adjusted for various boat types and sizes form the basis of the present invention.

Various embodiments of the present invention are designed primarily to elevate the boat out of the water when not in use. It has been determined that the optimum material for constructing such elevated docks is a suitable polymer. By utilizing a polymer, the detrimental effects of rust and corrosion are mitigated. It has also been contemplated to employ a polymer formulation that retards the types of contamination mentioned herein. In addition, the use of a polymer also presents numerous options for fabrication. The elevated dock can be heat welded, solvent welded, sonic welded, glued, roto-molded, or formed by any other suitable method.

Traditionally boat-lifts have basically been steel boat trailers fitted with pontoons. The present innovation is comprised of polymer pontoons, polymer gussets, polymer flat plates and polymer tubes.

There are numerous problems associated with elevating a boat out of the water for storage. For example, fixed support plates for the hull to rest upon do not conform to varied hull shapes and styles as a result only minimal support is provided for the hull creating detrimental pressure points to the hull. Elevated docks of the present invention solve this problem by providing a pinned connection has been developed to connect the support plates to the pontoons so the support plates conform to the shape of the hull providing maximum contact and support of the hull. Multiple anchoring holes serving as pin holes could also be provided to further the universal nature of the support plate connection.

Also, fitting and heat-welding a round pipe to a round pipe is difficult and very time consuming. The pipe deforms as temperatures vary and loads are applied making each connection unique. These problems combine to essentially result in building "custom" boat-lifts with every order. Custom manufacturing is incompatible with economical production manufacturing. However, this problem is avoided in the elevated docks of the present invention by using flat plate gussets cut to the proper shape to fit around the circumference of the main pontoon. These gussets are the support structure for the frame rather than round pipe. The flat plate can be slid into position and fillet welded (which is simpler and more economical) to the pontoon thus eliminating all of the costly coping and has the additional benefit of providing structural support to the pipe (pontoon) thus mitigating any distortion of its substantially circular transverse shape.

As mentioned above, providing periodic maintenance and inspection of the hull of a boat generally requires that the boat be removed from the water. Planks have been incorporated into presently known boat-lifts for this purpose. But, this innovation of an elevated dock contemplates integrating anchoring holes as service plank support mounts into the flat gussets for mounting service planks for both sides and possibly across the bow of the boat. The gussets may be designed with integral support positions and anchoring holes that accept the service planks as an optional or future accessory.

Presently, where rear vent valves are used, they have no limit to the amount they can rotate and excessive rotation may result in the valve disassembling. Currently, additional gusset plates and ropes are required to prevent over rotation from occurring. These additional ropes and gusset plates have the potential of becoming entangled in the boat propeller. The elevated docks of this innovation employ flat gussets to seal the rear ends of the pontoons. By extending these flat plates beyond the pontoon and incorporating a slot for each rear vent valve to pass through, the rotation of the rear exhaust port can be limited. Not only does this guide the rear vent valves to their proper positions when both up and down, but they also eliminate the need of any additional gussets or ropes.

Where it is now common to use tie downs (springer ropes) to attach the boat to the boat-lift, using round pipe for the boat-lift structure requires that cleats be heat-welded to the round pipe. The heat-welded connection has the potential of structural failure. This problem is avoided with the elevated docks of the present invention by using flat gussets that permit simple anchoring holes and cleats to be integral to the gussets, eliminating the need for cleats to be welded on.

Presently, boat-lifts must be anchored to a dock. Because of the constant movement of the water supporting the boat-lift in addition to the stress developed when the boat-lift is activated (lifting and/or lowering the boat), its connection to the dock creates undue stress and ultimately results in damage to the dock. For this reason, many marinas do not permit the use of boat lifts. However, the unique design of the elevated docks of the present invention does not require a connection to the dock. The elevated docks do not need to be perpendicular to the dock, they can also be positioned parallel to the dock. The elevated docks are free floating within the boat slip and can even be utilized with a harbor mooring buoy.

When utilizing presently known boat-lifts, it is never desirable for the bow of the boat to be lower than the stern, particularly since the boat is loaded from the stern. Accordingly, elaborate baffles have been employed inside of the pontoons to keep the water entering the pontoons during deployment at the rear of the pontoon and thus keeping the stern lower than the bow. In rough weather or during improper use of the boat-lift, the baffles can be ineffective, permitting the bow to become lower than the stern. Also, constructing baffles inside of a pipe is difficult and costly. The elevated docks of this innovation simply have a sealed pontoon at the front of the boat-lift perpendicular to the side pontoons so it is impossible for the bow of the boat to become lower than the stern. The connection of the sealed pontoon to the side pontoons is permitted to rotate so there is no restriction to the side pontoons sinking when filled with water. The sealed pontoon holds the front of the side pontoons out of the water while the rear of the side pontoons is permitted to freely sink. It is contemplated in an alternative embodiment of an elevated dock that buoyant material could be placed inside the front (perpendicular) pontoon to achieve the same goal.

There is an optimal position for the boat on the boat-lift to ensure it is stable and will be efficiently lifted out of the water when the pontoons are pressurized. The present design of known boat-lifts provides no mechanism to ensure the boat is properly positioned onto the boat-lift. The elevated docks of the present invention have a positive stop that provides feedback to the boat operator that the boat is positioned properly. The stop is adjustable to accommodate varied hull shapes and sizes.

Since presently designed boat-lifts are not adjustable, when a boat owner changes boats (i.e., upgrades), it often requires that a new boat-lift also be acquired. This problem is avoided in most instances because the elevated dock contemplates the use of adjustable rails so the boat-lift can simply be adjusted to length on site to fit the new boat. The main bracket assemblies can slide along the rails in order to position them where the weight of the boat is focused. Once the adjustment is made, a pin may be inserted, or a screw tightened, to lock the brackets into place. It may also require that the width be adjusted. The space between the pontoons can be adjusted using the telescoping or pin-and-slot adjustable lateral struts as cross members. Once the proper width is established, a pin may be inserted to lock the cross members into place. This innovative elevated dock also contemplates the use of telescoping pontoons. By combining concentric pontoons fitted together over a large o-ring, an adjustable and watertight seal is developed. The volume of the pontoons can then be adjusted by telescoping the pontoons back and forth. This provides the ability to increase or decrease the lift provided by the elevated dock, thus accommodating differing boat weights.

Anytime assembly is required involving hardware and the associated tools (wrenches, sockets, etc.) over water there is always the possibility of a piece of hardware or a tool falling into the water. This is usually inconvenient and can be very costly especially if the set up of the boat lift has been delayed. This elevated dock preferably uses hitch pins and/or cotter pins that do not require any tools. In addition, each hitch pin and/or cotter pin may have a lanyard that is attached to the polymer frame so it is not possible to drop any hardware into the water.

Since boat-lifts remain in the water at all times, they are subject to the same contamination as a boat would be, i.e. silt, algae, moss, barnacles, mussels, seaweed, spilled oil, etc. Also, presently most boat-lifts employ steel to form the structure that supports the boat while polymer pontoons provide the buoyancy necessary to lift the boat out of the water. Wet environments, particularly when salt is present, are highly corrosive to the steel structure. The elevated docks of the present invention are formed almost entirely of polymer. It is been contemplated to utilize a polymer formulation that retards the types of water contamination typically encountered in water storage. Such polymer also eliminates the issue of rust and corrosion.

Presently the boat-lifts that employ steel to form the structure that supports the boat use polymer pontoons provide the buoyancy necessary to lift the boat out of the water. However, this design positions the boat relatively high out of the water, which is not ideal. The higher the boat, the less stable it becomes. In addition, some communities restrict the use of boat-lifts because of the impact to site lines. The innovative elevated docks of the present invention do not employ a steel structure. The boat simply rests on the pontoons resulting in the lowest possible profile.

Also, present boat-lifts with steel structure for supporting the boat may use polymer pontoons to provide the buoyancy necessary to lift the boat out of the water. But, steel is very heavy requiring a greater amount of lift, hence requiring larger pontoons. This can be an issue of available space in an existing slip, but it also has a detrimental effect if the pontoons dwarf the boat making it appear out of scale. Since the elevated docks are formed almost entirely out of polymer, unnecessary weight is eliminated, maintaining a very lightweight structure requiring minimally sized pontoons.

Storing a boat on an elevated platform in open water presents the risk of not being adequately stable to ensure that the boat is never tipped over in rough waters. The elevated docks of the present invention may use sea anchors hung from the bottom of the pontoons thus ensuring a stable platform even in rough waters. It is also contemplated to use stabilizing plates that extend horizontally or vertically along the length of the pontoons.

Typically boats are very vulnerable to damage from the dock in rough weather or if the boat has not been properly tied and is permitted to bump into the dock. The elevated dock of the present invention eliminates this problem since the boat is elevated above the dock.

Presently boat-lifts rely on the valves at the pump to prevent the boat-lift from sinking. If the valves fail or the hose develops a leak, the boat-lift may sink. The elevated docks of the present invention may have two exhaust ports that if positioned in the vertical position, prevent water from entering the pontoons, thus mitigating the chance of accidentally sinking the elevated dock.

Sailboats have all of the same issues as do conventional motor boats when stored in water (contamination from silt, algae, moss, barnacles, mussels, seaweed, spilled oil, etc.), however, because the depth of the keel is so much greater for a sailboat, conventional boat-lifts cannot accommodate the deeper keels. The keel hits the cross members of the boat-lift while attempting to dock. By lengthening the pontoons it might be possible to accommodate the increased keel depth but it would be necessary to sink the boat-lift much deeper than usual which may not be possible in shallow water. An embodiment of the elevated dock of the present invention may have optional articulated pontoons which accommodate the deeper keel of a sailboat. By adding a second section of pipe at the rear of the pontoon with a pin jointed pivot connection sufficient clearance for the keel can be achieved. The rear cross member may be located between these two rear-most pontoons. Hoses may be added to span across the articulated connection, thus permitting air and water transfer into the rear-most pontoons. The rear-most pontoons are then filled with water first so they sink first. The angle at which the rear-most pontoons sink compared to the front pontoons can be regulated depending upon the size of the sailboat and the depth of its keel. Once clear of the keel the rear-most pontoons can be pressurized. The front pontoons may then be pressurized thereby elevating most if not all of the keel out of the water. The articulated pontoons of the elevated dock greatly reduces the necessary water depth required to accommodate a sailboat.

Further, it is not unusual for boat owners to also own personal watercraft (for example, Wave Runners). The storage of these smaller crafts is a challenge since they need to be stored but they hardly justify paying for an additional slip. The innovative elevated dock contemplates extending the length of the pontoons or simply adding additional pontoon sections at the front of the elevated dock to create a platform for personal watercraft. Typically, the personal watercraft would be loaded first followed by the boat. Additionally, personal watercraft have all of the same issues as do conventional motor boats when stored in water (contamination from silt, algae, moss, barnacles, mussels, seaweed, spilled oil, etc.). It is contemplated that a smaller scale version of the elevated dock of the present invention may be used for the purpose of storing personal watercraft. It is also contemplated that an elevated dock designed to store multiple personal watercrafts, including but not limited to, canoes, kayaks, rafts, etc. can be constructed using the concepts disclosed herein.

The rear exhaust ports used for exhausting water for the act of lifting and exhausting air for the act of sinking the pontoons while operating known boat-lifts are simply open pipes to the elements. In excessive rain and or rough weather water can invade the system. To avoid this problem, the elevated dock of the present invention may have an elbow at the end of each exhaust pipe to mitigate the intrusion of water into the system.

It is typically required that known boat-lifts be delivered and installed by the manufacturer or someone trained as an installer. This adds delays and cost when acquiring a boat-lift. The elevated docks of the present invention are designed with integral flanges and attachment points specifically designed for securing the elevated dock to any boat trailer. The assembly has been simplified to eliminate the need for a skilled installer. With the innovation of tailoring the elevated dock for delivery on a boat trailer, the elevated dock can simply be deployed off of the boat trailer from any conventional boat ramp. Once in the water, it is simply a matter of assembling the elevated dock, towing it to the appropriate slip, and making the final adjustments for fit.

BRIEF DESCRIPTION OF THE DRAWINGS

Exemplary embodiments of the invention will become more fully apparent from the following description and appended claims, taken in conjunction with the accompanying drawings. Understanding that these drawings depict only exemplary embodiments and are, therefore, not to be considered limiting of the invention's scope, the exemplary embodiments of the invention will be described with additional specificity and detail through use of the accompanying drawings in which:

DETAILED DESCRIPTION

Figure 1:
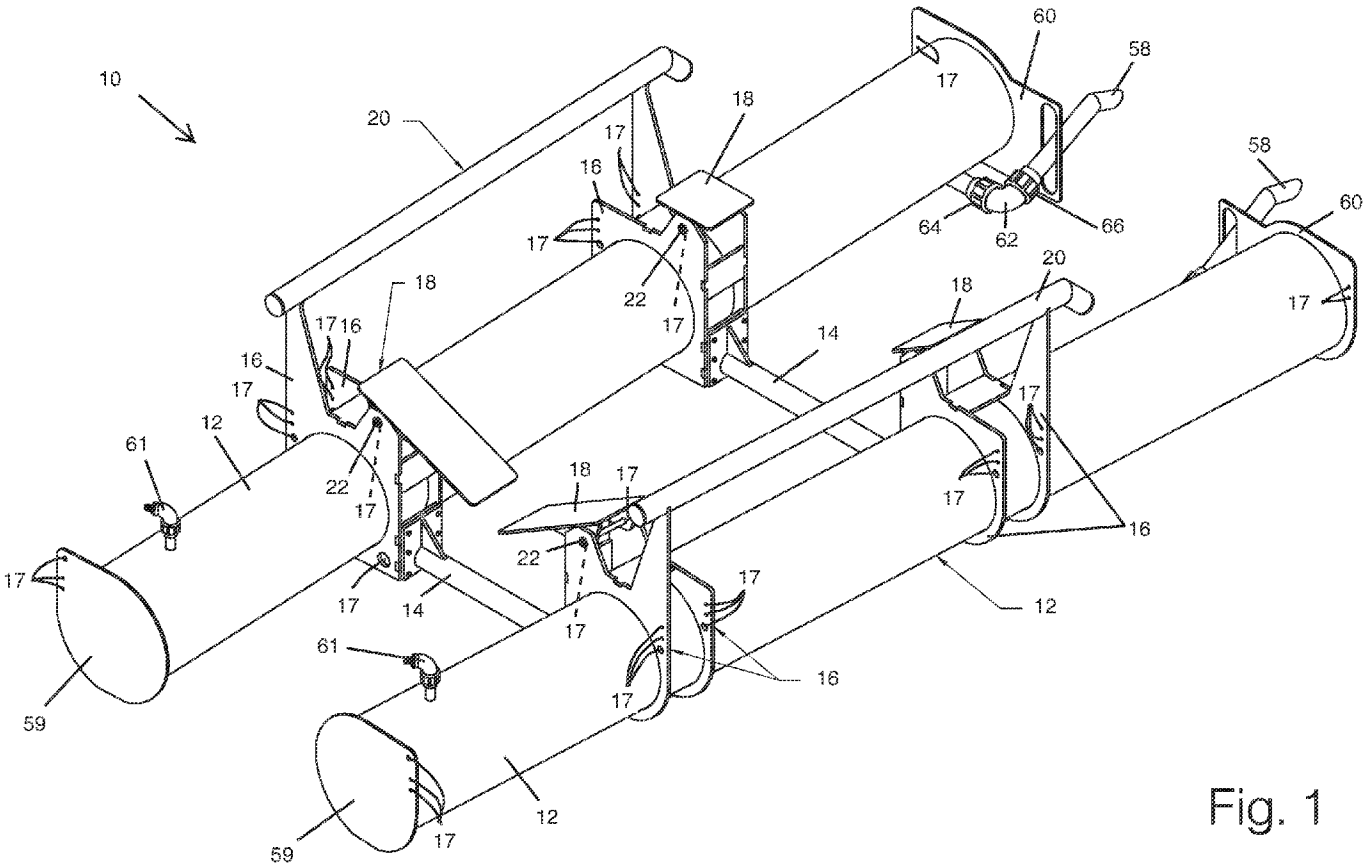
FIG. 1 is a front isometric view of one embodiment of the elevated dock of the present invention.
Figure 2:
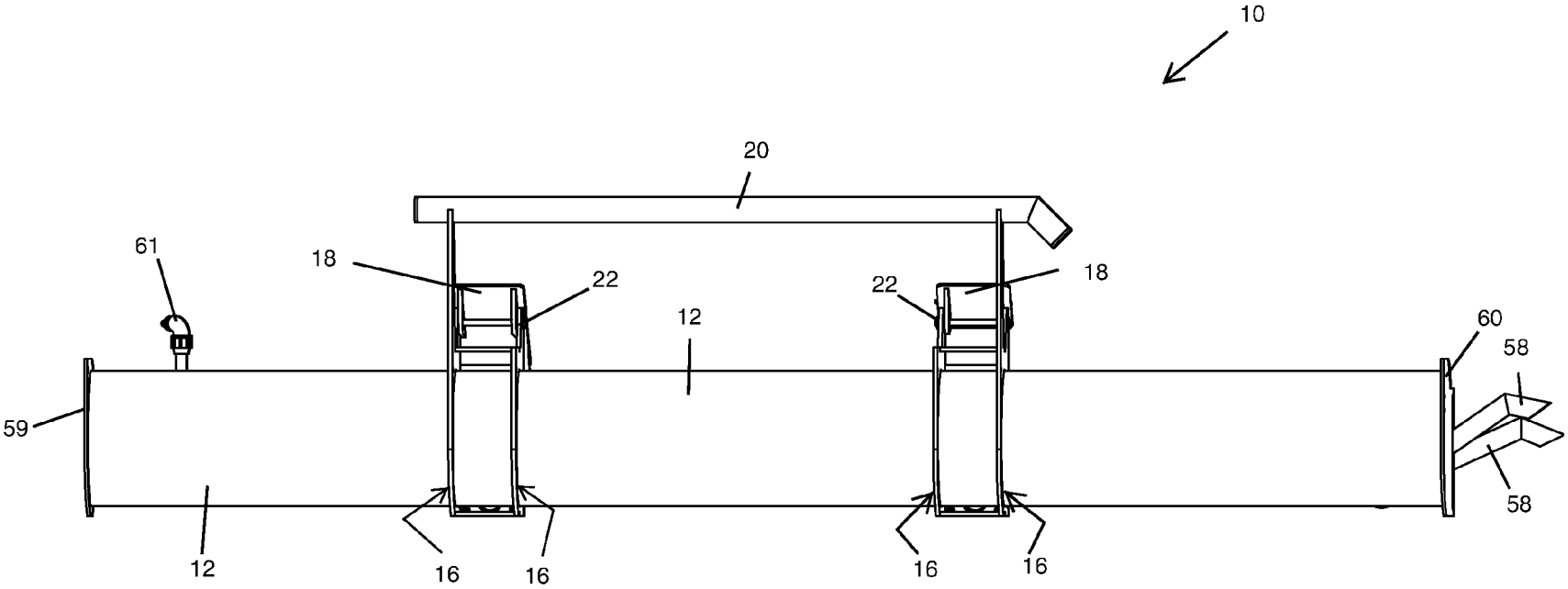
FIG. 2 is a side view of the elevated dock of FIG. 1.
Figure 3:
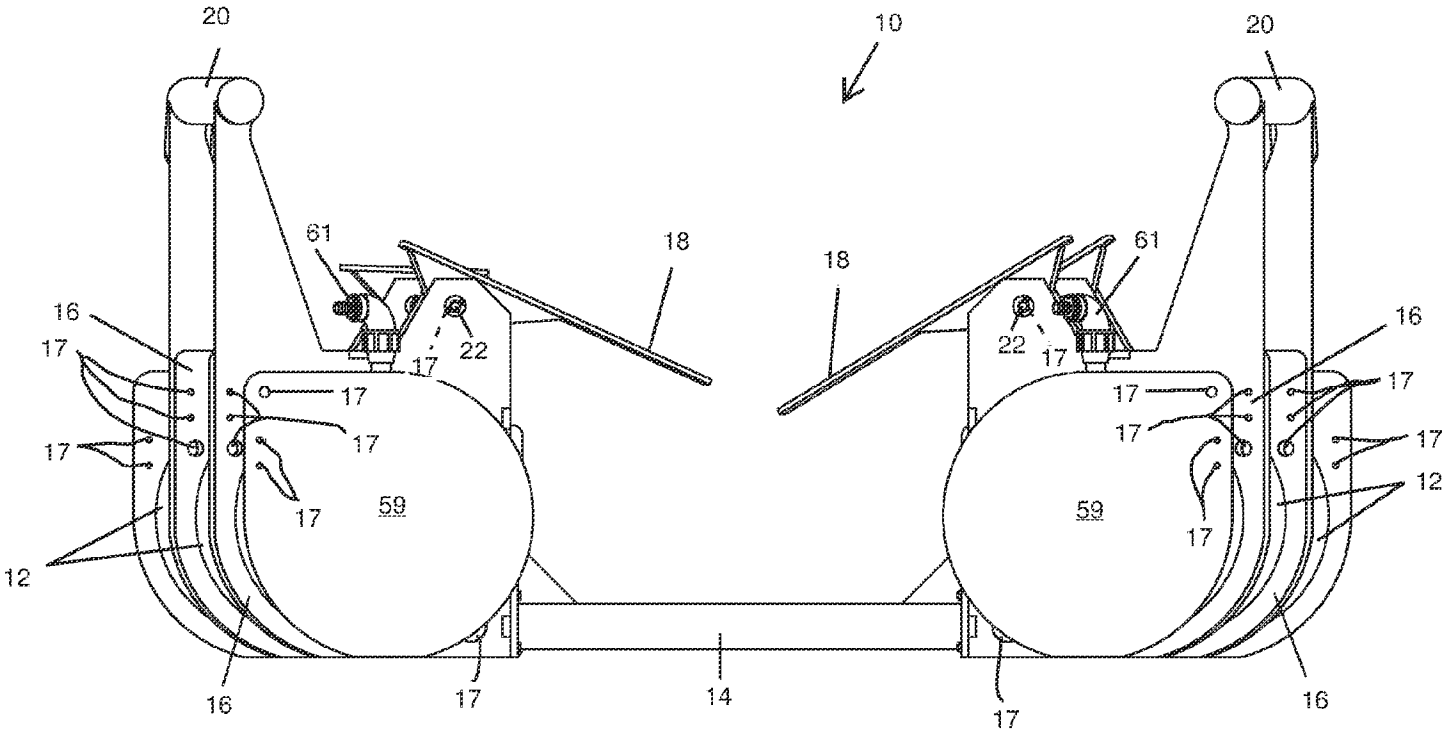
FIG. 3 is a front view of the elevated dock of FIG. 1.
Figure 4:
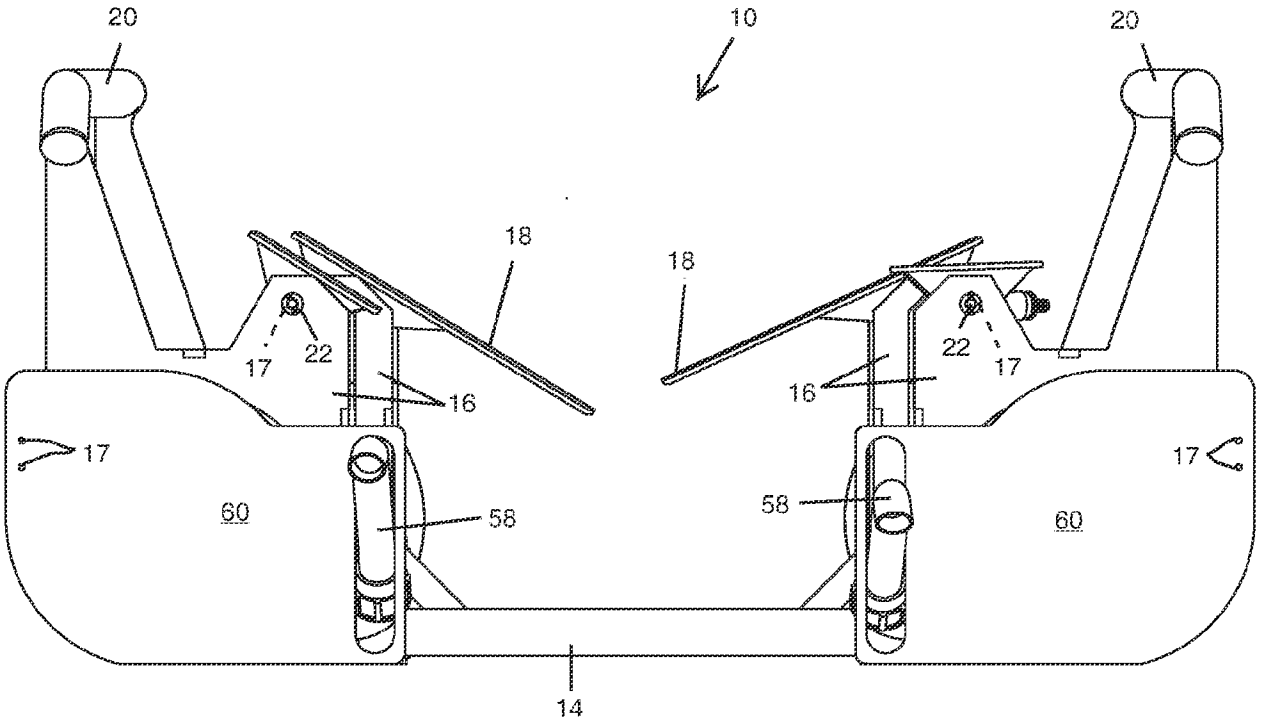
FIG. 4 is a rear view of the elevated dock of FIG. 1.
Figure 5:
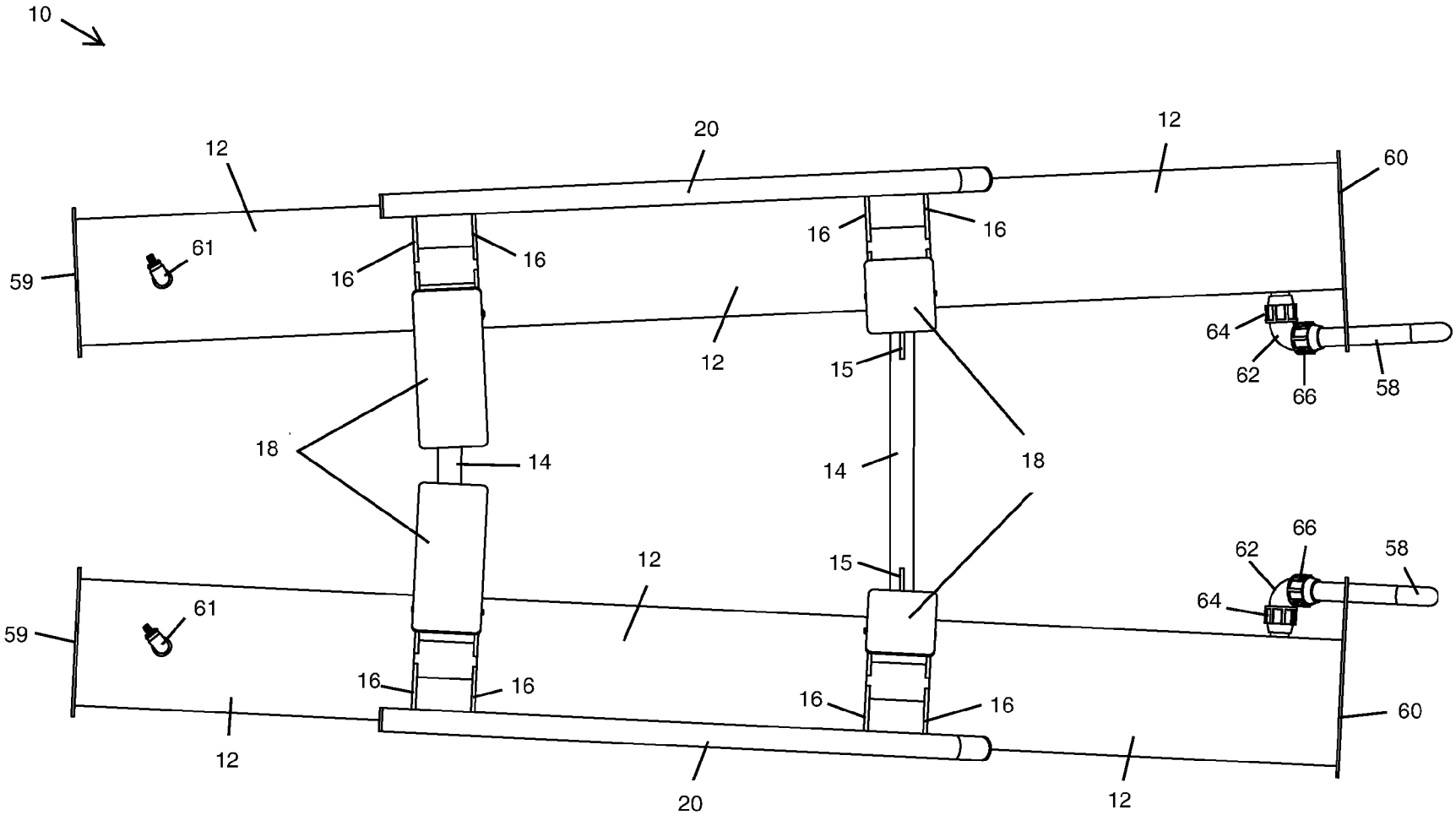
FIG. 5 is a top view of the elevated dock of FIG. 1.
Figure 6:
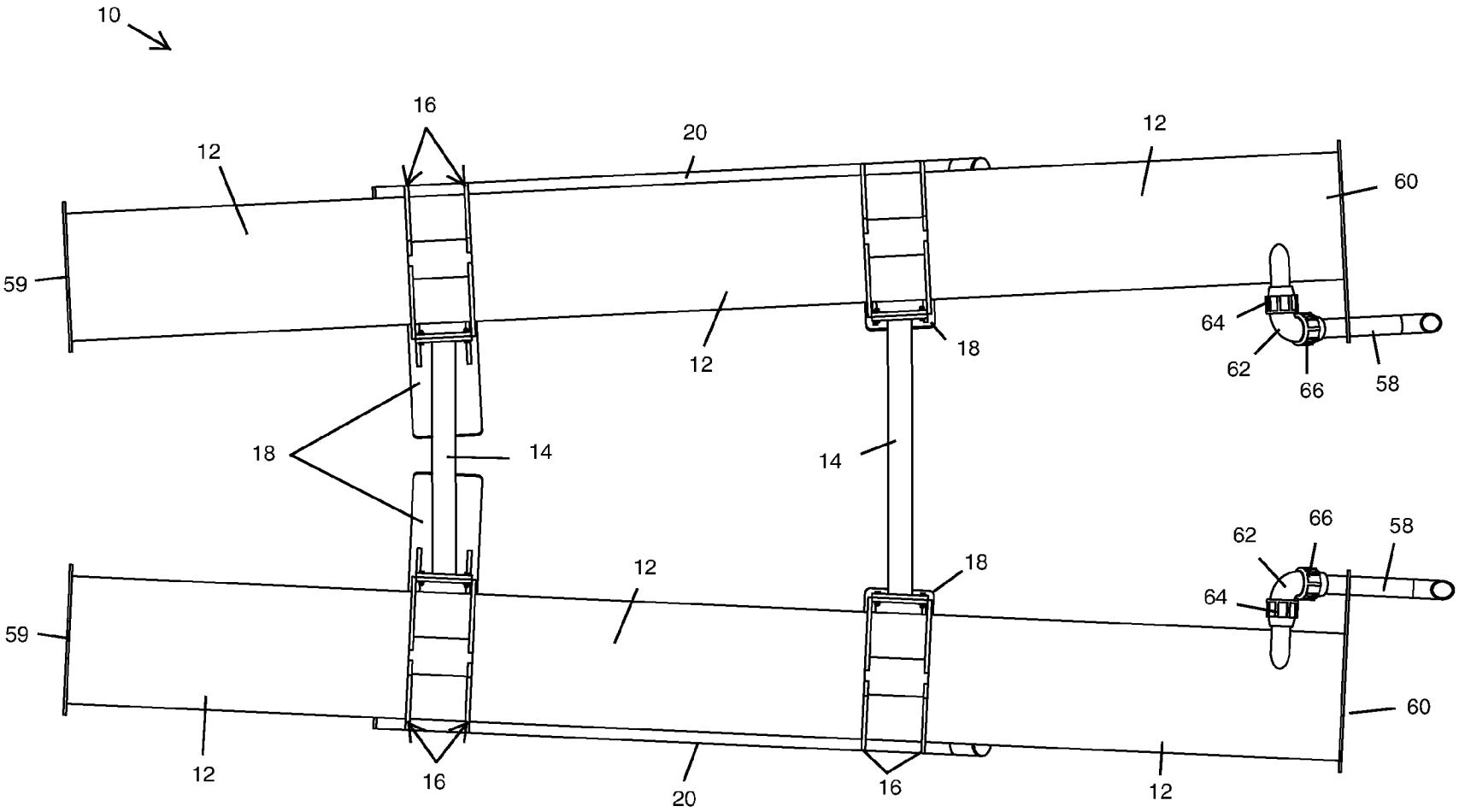
FIG. 6 is a bottom view of the elevated dock of FIG. 1.

FIGS. 1-6 show a basic preferred embodiment of the elevated dock 10 of the present invention. The elevated dock 10 has pontoons 12 disposed non-parallel to each other and held spaced apart by lateral struts 14 (which may or may not be length adjustable). As shown in FIG. 5, lateral struts 14 have strut slots 15 to facilitate the length-adjustability of the lateral struts 14. Of course, the length-adjustability of the lateral struts 14 can be accomplished in any of a number of ways know to those skilled in the art, including but not limited to, pin-and-slot adjustment and telescoping adjustment.

About each pontoon 12 are flat plate gussets 16 that maintain the transverse circular shape integrity of the pontoons and serve as mounting support for the angled support plates 18 and the longitudinal bumper 20. Flat front gussets 59 and flat rear gussets 60 serve to seal the ends of each pontoon 12 The flat plate gussets 16 may have simple holes 17 (sometimes referred to herein as anchoring holes 17 or pin holes 17) or cleats that eliminate the need for cleats to be welded to the pontoons 12 and/or to provide mounting support for a support plate connection, service planks, or other optional accessories. An adjustable configuration of the elevated dock 10 enables boats of various sizes and styles to be lodged on the elevated dock 10 and lifted from the water.

The pontoons 12, flat plate gussets 16, flat front and rear gussets 59, 60, and the lateral struts 14 are preferably constructed of a polymer which lightweight and suitable for providing structural integrity and resistant to the effects of rust and corrosion. These component parts of the elevated dock 10 can be assembled and secured using any suitable method such as by heat welding, solvent welding, glue or other adhesive, roto-molding, sonic welding or any other suitable method.

The pontoons 12 can be filled with water by allowing air to escape from the pontoon 12 to be replaced by water. This will submerge the pontoons 12 to position them for engagement with the boat to be lifted. Once the boat is properly positioned on the partially submerged elevated dock 10, pressurized air can be introduced into the pontoons 12 from a pneumatic pump (not shown) via pneumatic couplers 61 located on the pontoons 12. As air fills a pontoon 12, water within the pontoon 12 is replaced by air and the water exits the pontoon 12 through the rear exhaust port 58. As the air replaces the water within the pontoons 12, the boat is lifted from the water to rest above the water line on the elevated dock 10.

Figure 7:
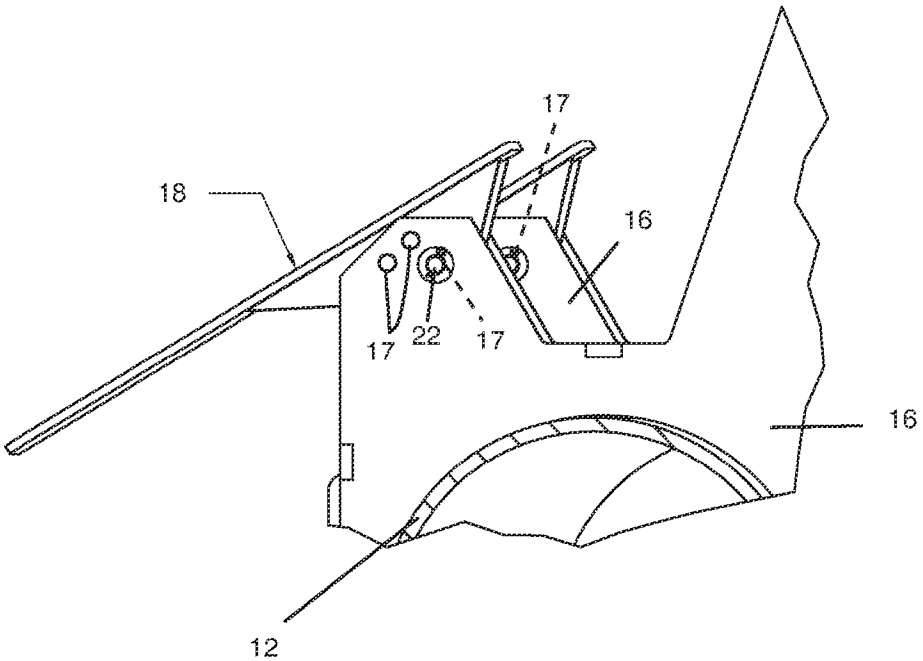
FIG. 7 is a cut-away perspective view showing the pinned connection of a support plate for the elevated dock.

A pinned connection 22 of support plates 18 to anchoring holes 17 of the respective flat plate gussets 16 for the elevated dock 10, as shown in FIG. 7, permits the support plates 18 to pivot when engaged by the hull of a boat to support the boat in a nestled engagement as the boat is safely lifted and elevated out of the water using a "balanced lift." To accommodate various boat sizes, multiple anchoring holes 17 may serve as pin holes 17 so that the support plates 18 can be connected by the pinned connection 22 best suited for the size of boat being lifted.

Figure 8:
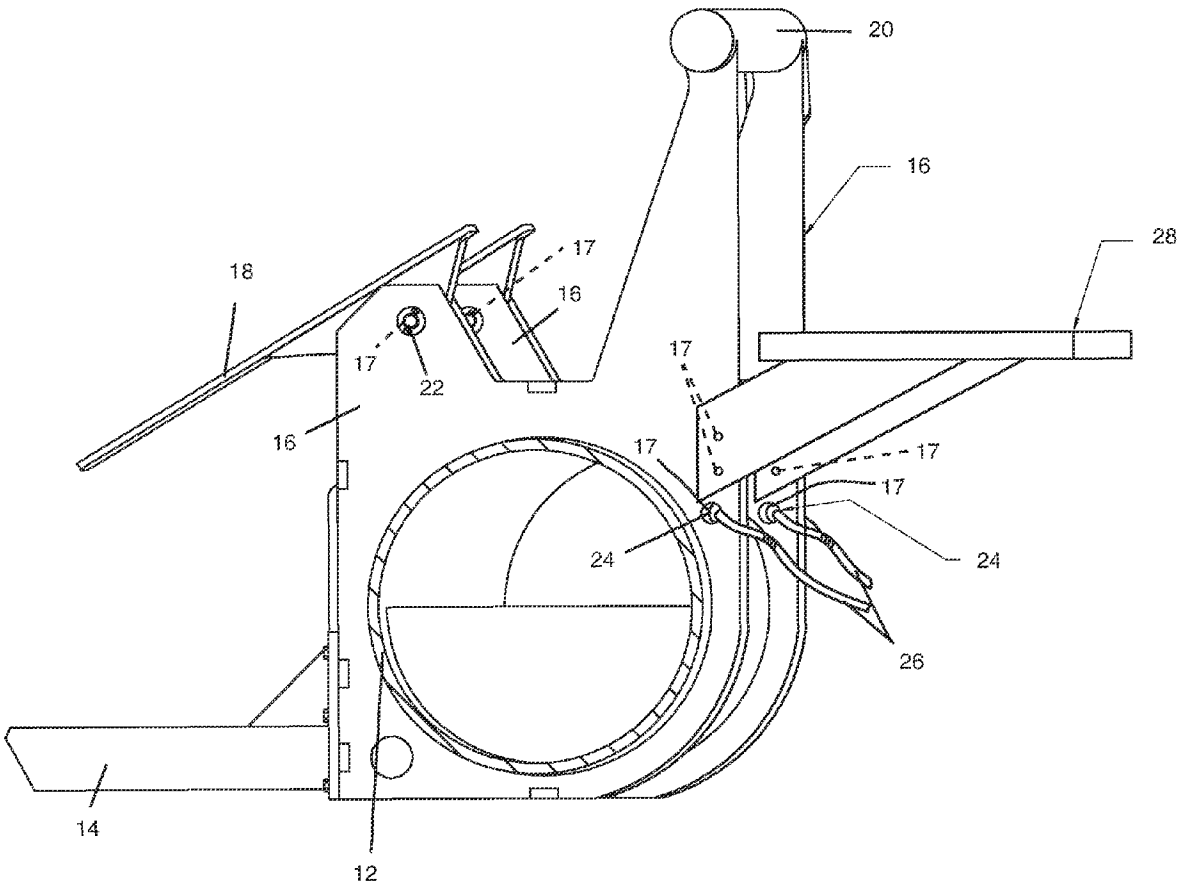
FIG. 8 is a partial, front perspective, sectional view of a pontoon showing alternative springer rope holes, springer ropes, and a service plank.

FIG. 8 is a partial, front perspective view of a pontoon 12 showing alternative springer rope holes 24, springer ropes 26, and a service plank 28. The springer ropes 26 can be used to moor the elevated dock 10 to a dock or a buoy. The service plank 28 provides footing for maintenance personnel to perform various maintenance tasks and/or access to a boat lifted by the elevated dock 10. The service plank 28 may be mounted on the flat gussets 16 using the anchoring holes 17 on either side of the elevated dock 10 or even across the bow of the boat.

Figure 9B:
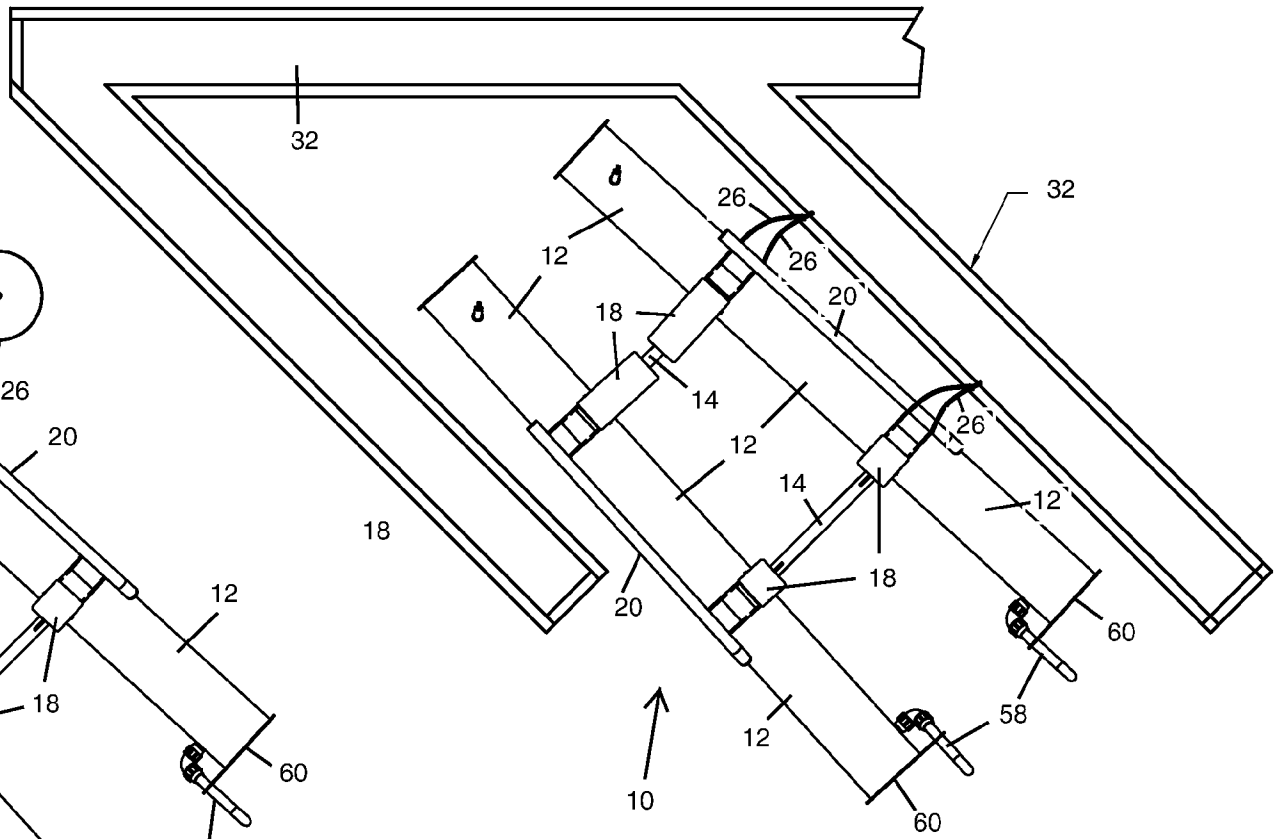
FIG. 9B is a top view of the elevated dock as connected to a dock to illustrate an alternative mooring allowing the elevated dock to be free-floating.
Figure 9A:
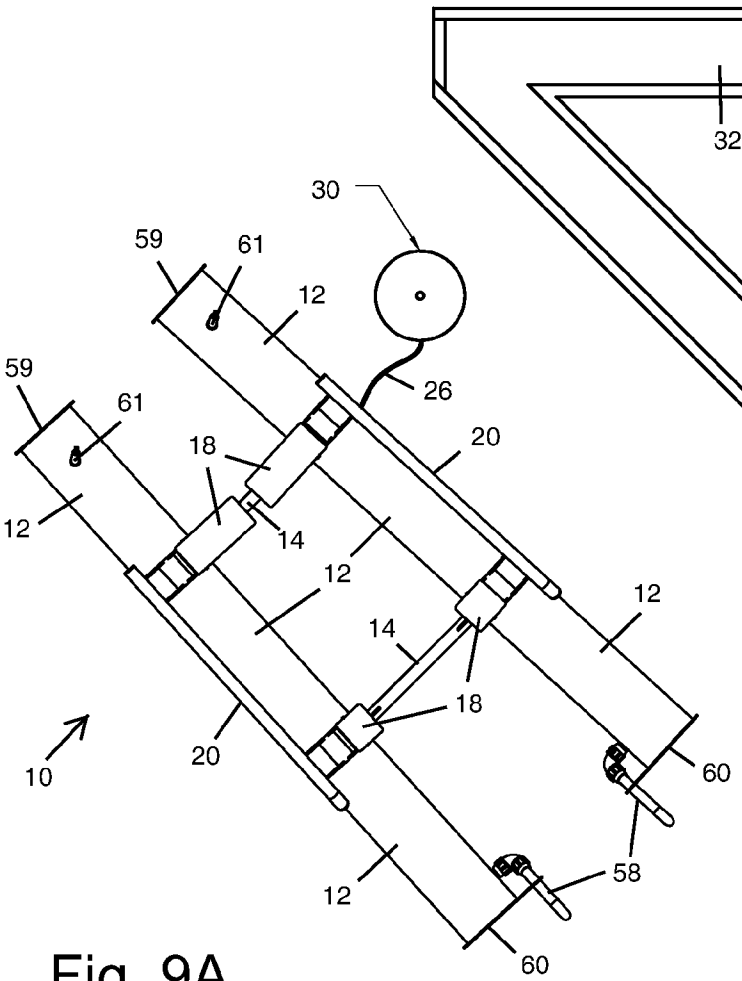
FIG. 9A is a top view of the elevated dock as connected to a mooring buoy to illustrate a mooring allowing the elevated dock to be free-floating.

The views of FIGS. 9A and 9B show alternatives for mooring the free-floating elevated dock 10 to a mooring buoy 30 and a dock 32. Due to the configuration of the elevated dock 10, it is not necessary to attach the elevated dock 10 to a stationary or permanent dock 32, but can be used in a mooring application. With the dock mooring, unwanted stress to the dock 32 is eliminated and the boat lifted by the elevated dock 10 is less susceptible to damage during rough weather because the boat is elevated above the dock 32.

Figure 10A:
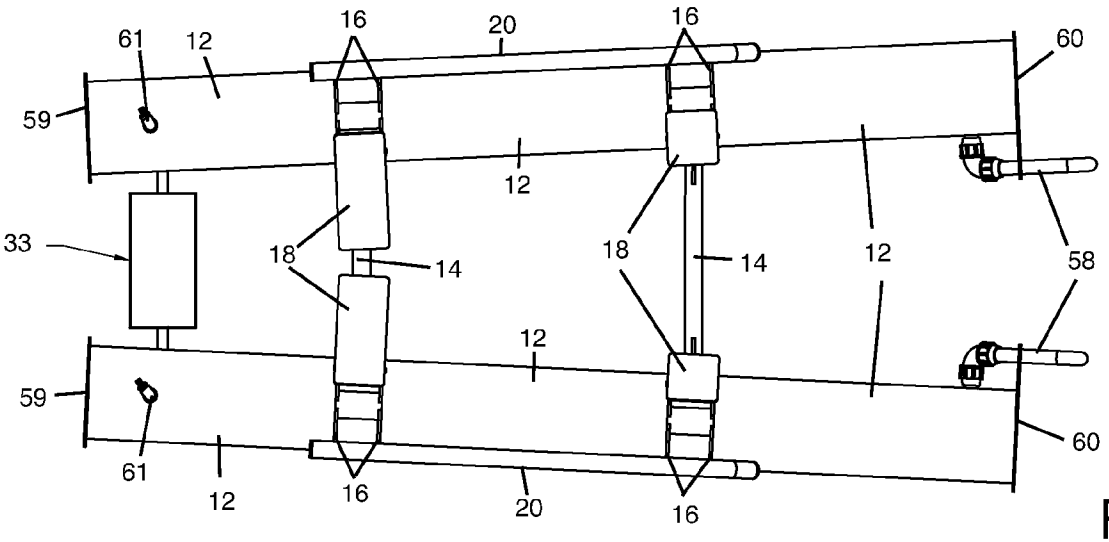
FIG. 10A is a top view of an alternative elevated dock showing the use of a buoyant sealed pontoon.
Figure 10B:
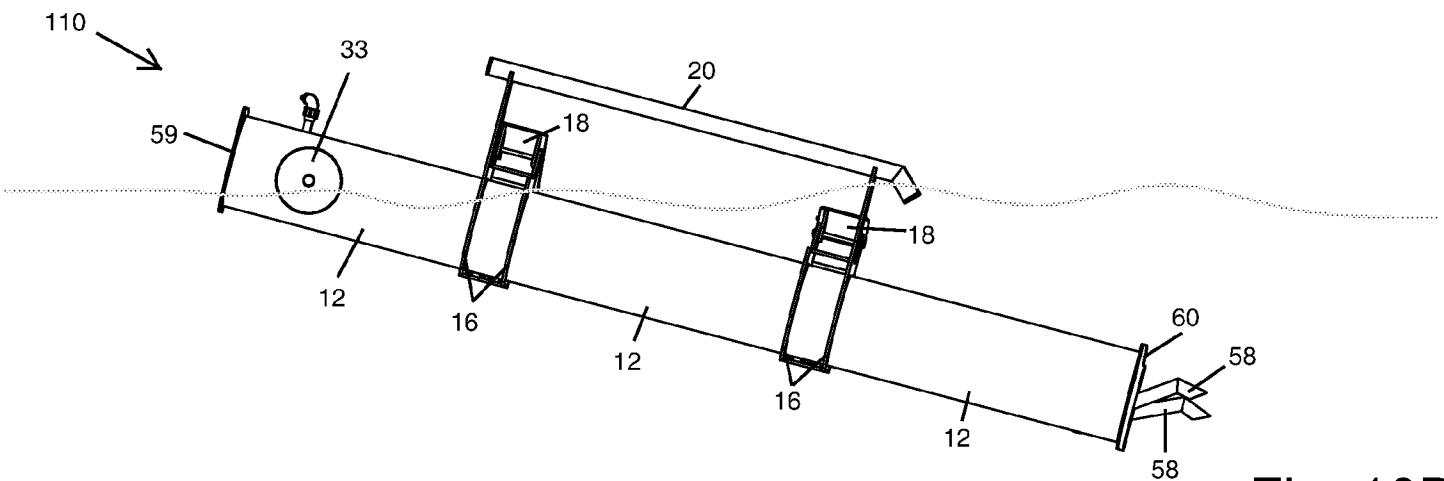
FIG. 10B is a side view of the alternative elevated dock of FIG. 10A showing the use of a buoyant sealed pontoon to keep a portion of the elevated dock above water level.

An alternative elevated dock 110 is shown in FIGS. 10A and 10B which includes a top view and a side view of the alternative elevated dock 110 using a buoyant sealed pontoon 33 to keep a portion of the elevated dock 110 above water level. In this manner, the elevated dock 110 cannot sink. Also, for boat-lifting situations, such as during rough weather, requiring that care be taken to assure that the stern of the boat being lifted remains below the bow, the elevated dock 110 with the buoyant sealed pontoon 33 is particularly suitable.

Figure 11:
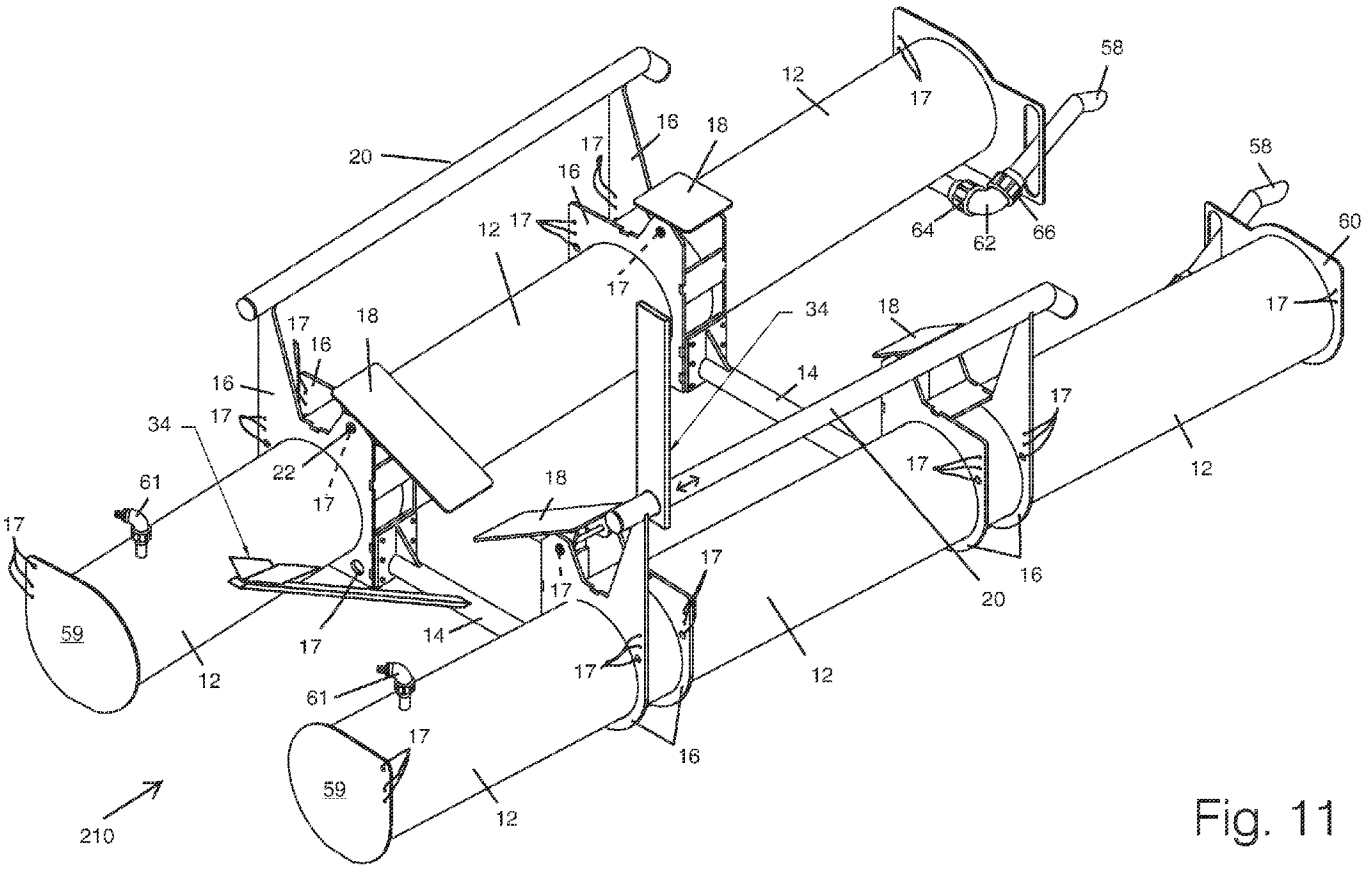
FIG. 11 is a perspective view of an alternative elevated dock showing positive stops to assist in positioning a boat on the elevated dock.
Figure 12:
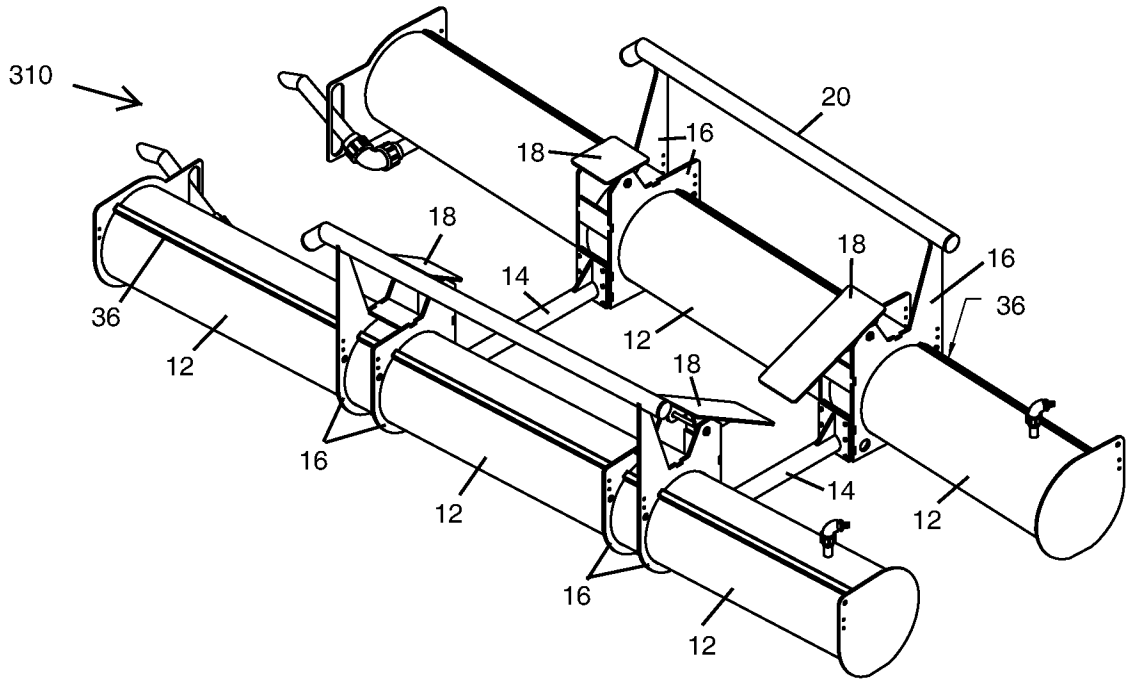
FIG. 12 includes a perspective view of two alternative elevated docks showing an adjustable slide rail provided for structural integrity.

Optional accessories are shown in FIGS. 11 and 12. FIG. 11 shows an alternative elevated dock 210 with positive stops 34 to assist in positioning a boat on the elevated dock in nestled engagement. To accommodate different sized boats, it is advantageous to have adjustable positive stops 34. For example, the two-way arrow shown on the bumper 20 in FIG. 11 illustrates how the position of the positive stop may be adjusted along bumper 20.

FIG. 12 shows an alternative elevated dock 310 with adjustable slide rails 36 which provide structural integrity and surfaces to which other accessories can be attached.

Figure 13:
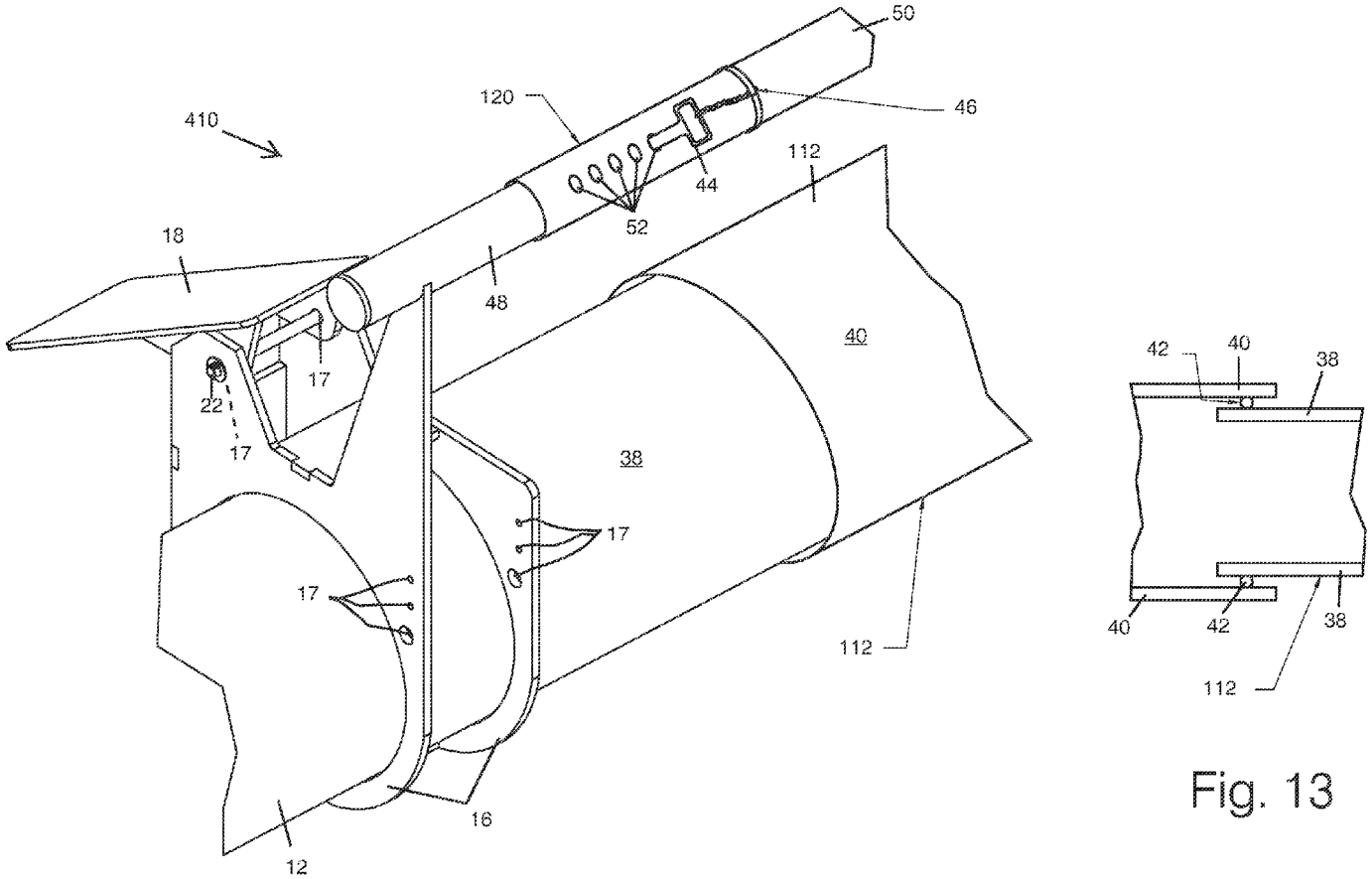
FIG. 13 includes a partial perspective view of a telescoping pontoon for an alternative elevated dock and a cut-away sectional view of the telescoping pontoon showing how the pontoon can be sealed using an O-ring.

FIG. 13 illustrates a telescoping pontoon 112 with a male pontoon portion 38 and a female pontoon portion 40 that provides for length-adjustability for the alternative embodiment of the elevated dock 410. Each telescoping pontoon 112 can be sealed using an O-ring 42 or other suitable means known to those skilled in the art. The length-adjustability enables the elevated dock 410 to fit various size and models of boats. Also, virtually every size and model of boat can be accommodated by a limited number of different sized elevated docks 410 that can be mass produced. The ability to provide a boat lift with mass produced parts and assembly is a significant advantage over existing boat lifts which are typically custom-made and extremely expensive.

With the length-adjustable embodiment of elevated dock 410, it can be advantageous to also have an adjustable telescoping bumper 120 with a male bumper portion 48 and a female bumper portion 50. One way to provide length-adjustability to the telescoping bumper 120 is to provide adjustment holes 52 in either the female or male bumper portion 50, 48 and a setting hole (not shown) in the other portion to be aligned so that a hitch pin 44 can be passed therethrough to secure the telescoping bumper 120 to the desired length. To avoid the hitch pin 44 being unintentionally dropped into the water a lanyard 46 can be secured to the hitch pin 44 and the bumper 120.

Figure 14B:
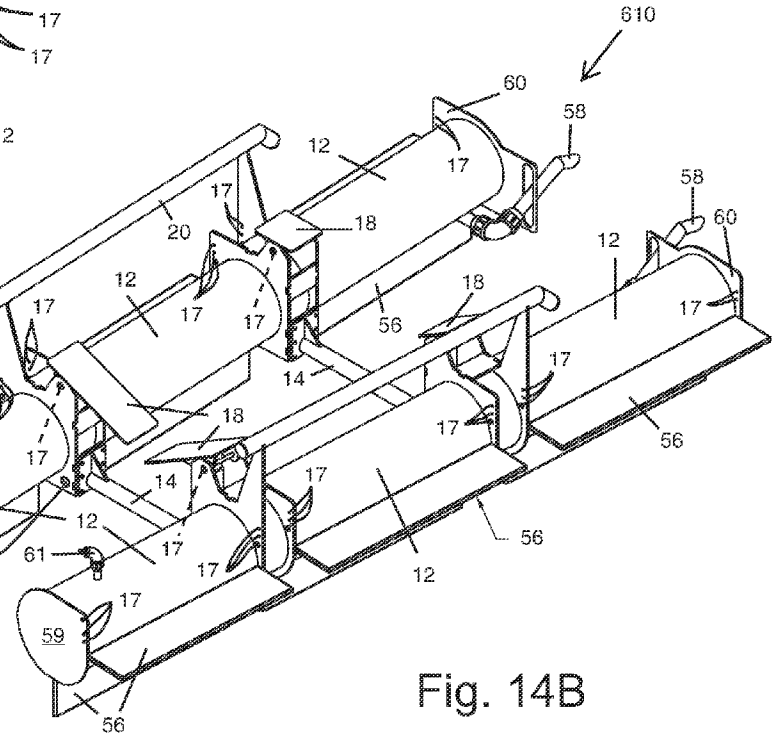
FIG. 14B is a perspective view of another alternative elevated dock showing various vertical and horizontal stabilizing plates deployed to stabilize the elevated dock.
Figure 14A:
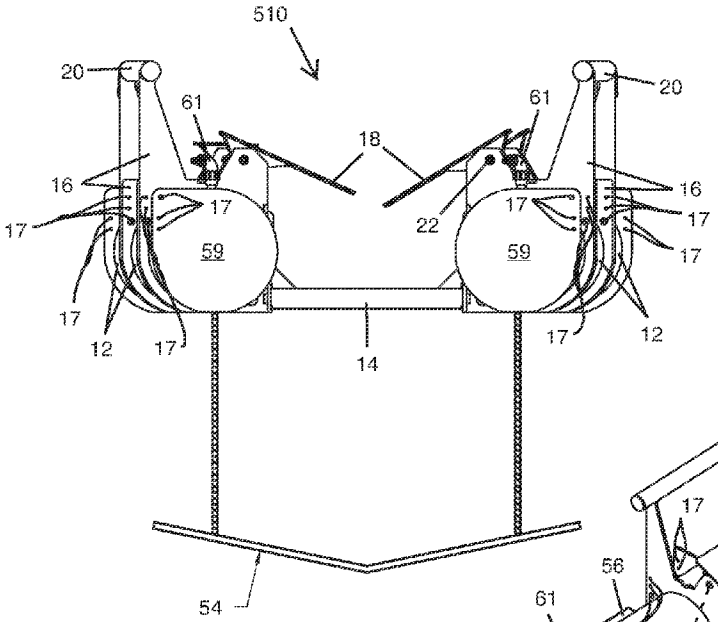
FIG. 14A is a front elevation view of an alternative elevated dock with a sea anchor attached.

The elevated dock 10 of the present invention may use various types of stabilizers to maintain stability of the boat and elevated dock 10 in rough waters. For example, FIG. 14A shows an alternative elevated dock 510 with a sea anchor 54 attached and FIG. 14B shows another alternative elevated dock 610 with various stabilizing plates 56 (both vertical and horizontal) deployed to stabilize the elevated dock 610.

Figure 15:
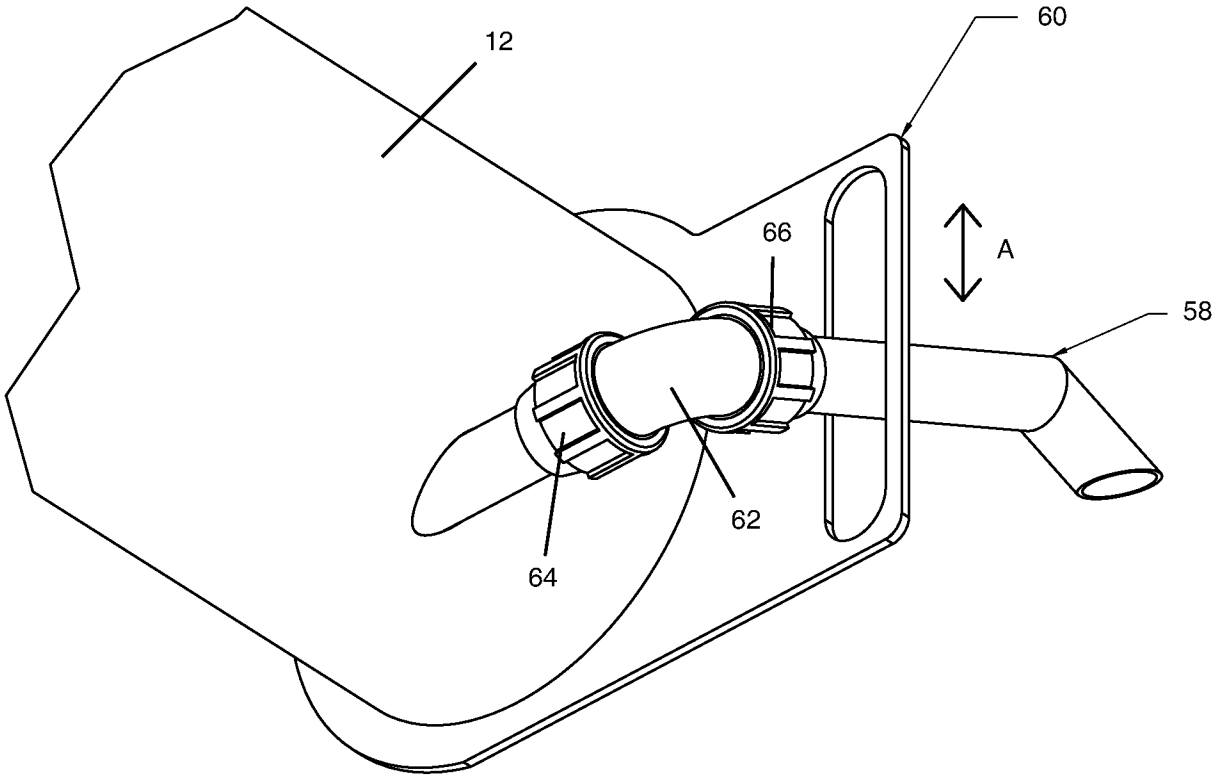
FIG. 15 is a partial perspective view of the rear of a pontoon showing the closure and the positionable rear exhaust port.

FIG. 15 shows the closure of the rear of a pontoon 12 and an example of how the rear exhaust port 58 can be adjustably positioned. The flat rear gusset 60 seals the end of the pontoon 12 and facilitates the adjustable positioning of the rear exhaust port 58. The rear exhaust port 58 has an adjustable elbow 62 with a vertical adjustment collar 64 and a rotational adjustment collar 66. By loosening the vertical adjustment collar 62, the rear exhaust port 58 can be moved vertically within the slot in the flat rear gusset as shown by Arrow A. When the desired vertical position is reached, the rear exhaust port 58 can be secured by tightening the vertical adjustment collar 64. The position of the end of the rear exhaust port 60 can be directed as desired by loosening the rotational adjustment collar 66, rotating the end to its desired orientation, and then secured by tightening the rotational adjustment collar 66.

Figure 16A:
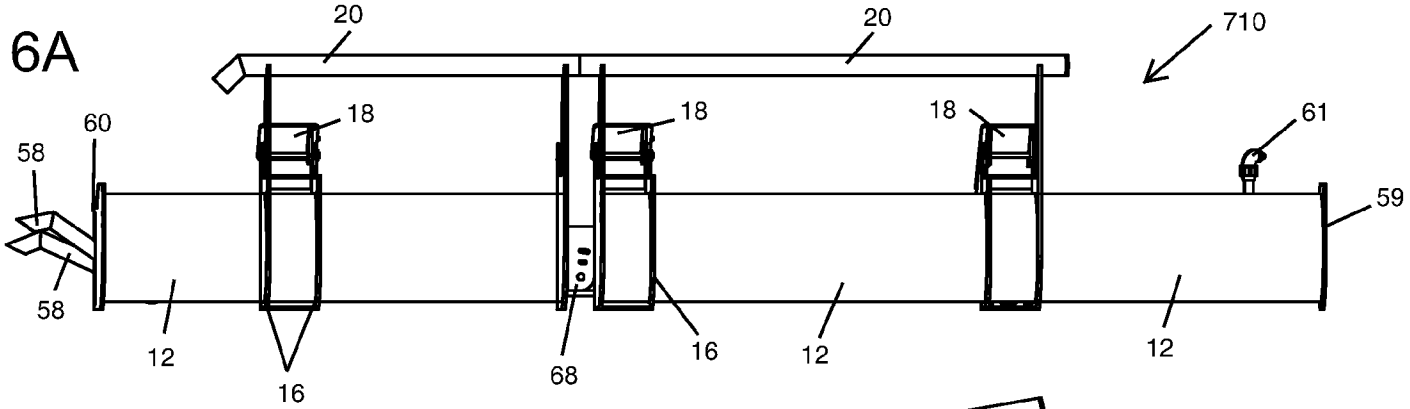
FIG. 16A is a side view of an alternative elevated dock configured to have an articulating sailboat lift, showing the unarticulated configuration.
Figure 16B:
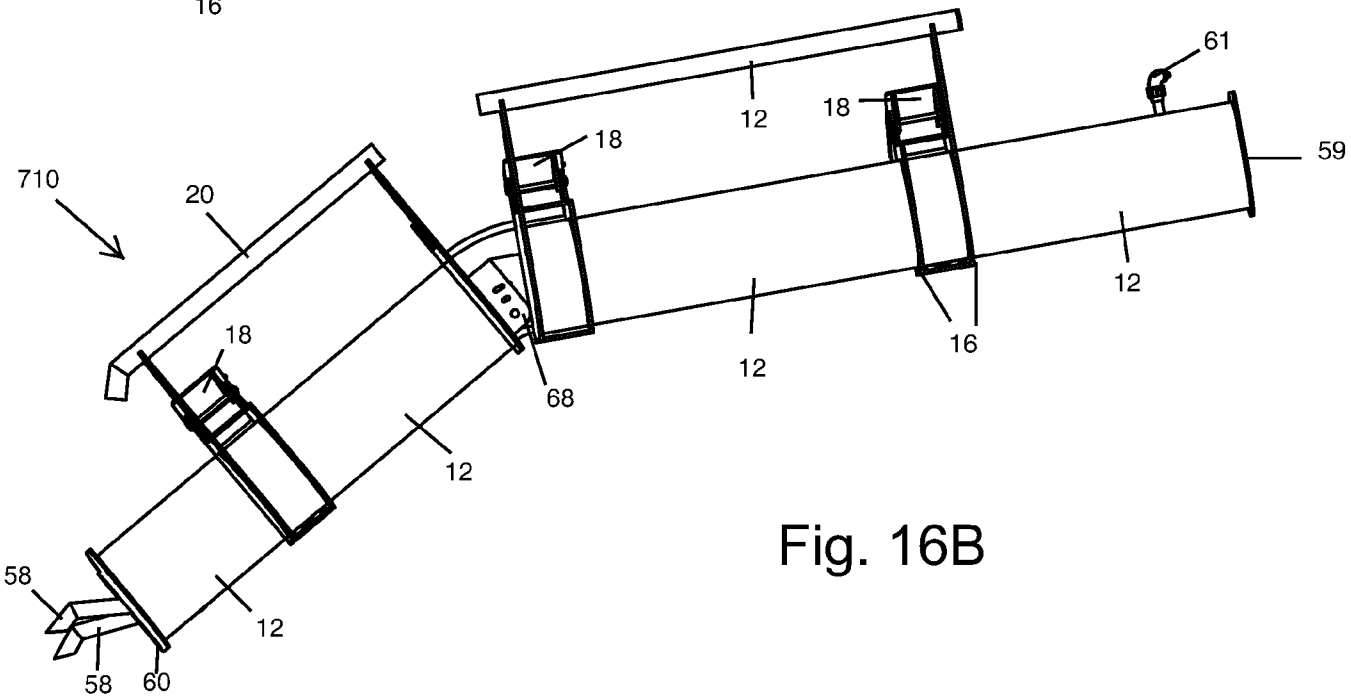
FIG. 16B is another side view of the alternative elevated dock of FIG. 16A with an articulating sailboat lift, showing the articulated configuration.

Another alternative elevated dock 710 accommodates sailboat hulls. An exemplary elevated dock 710 is shown in FIGS. 16A and 16B that is configured to have an articulating sailboat lift. The articulating embodiment of elevated dock 710 utilizes an articulation hinge 68 of any suitable type and size. FIG. 16A shows the unarticulated configuration while the view in FIG. 16B shows the articulated view.

Figure 17:
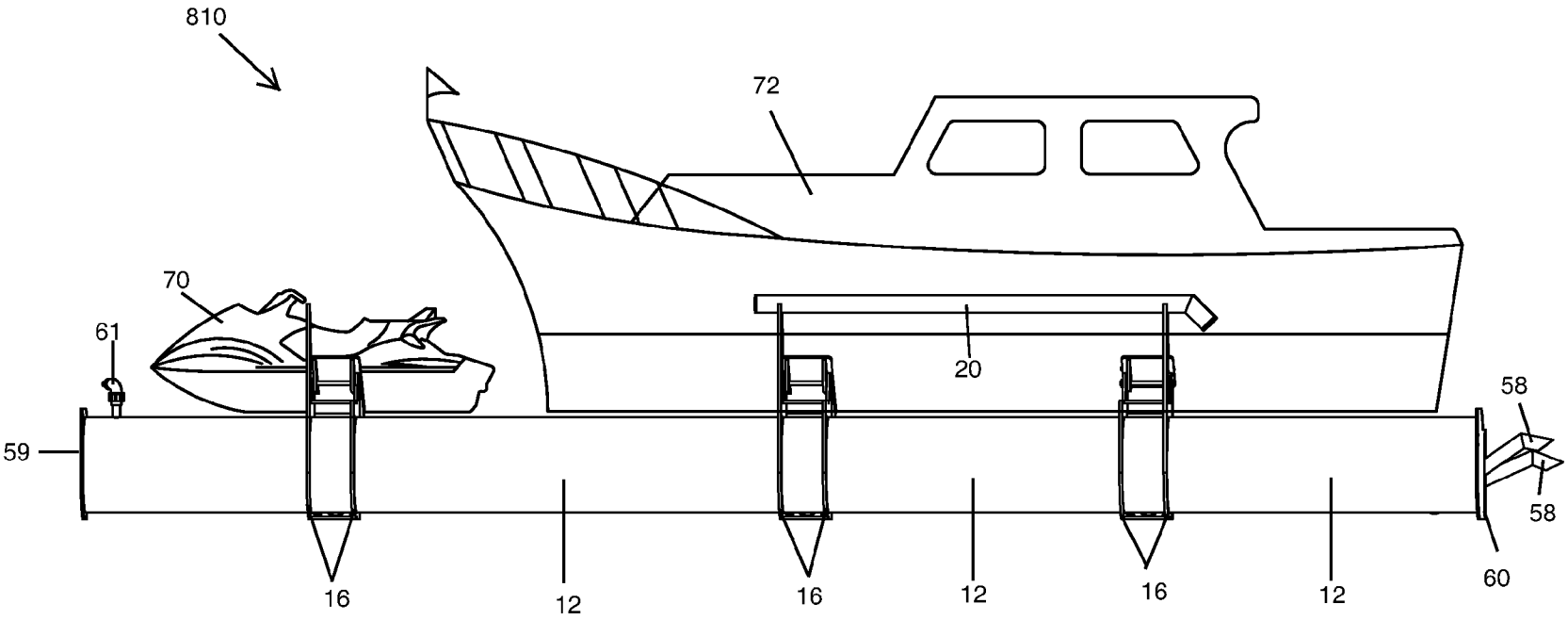
FIG. 17 is a side view of an alternative elevated dock showing both a boat and a personal watercraft as lifted by the elevated dock.

Many boat owners also have personal watercraft 70. Still another alternative elevated dock 810 can accommodate both a boat 72 and one or more personal watercraft 70. FIG. 17 shows an exemplary alternative elevated dock 810 with both a boat 72 and a personal watercraft 70 lifted and secured above water level.

Figure 18A:
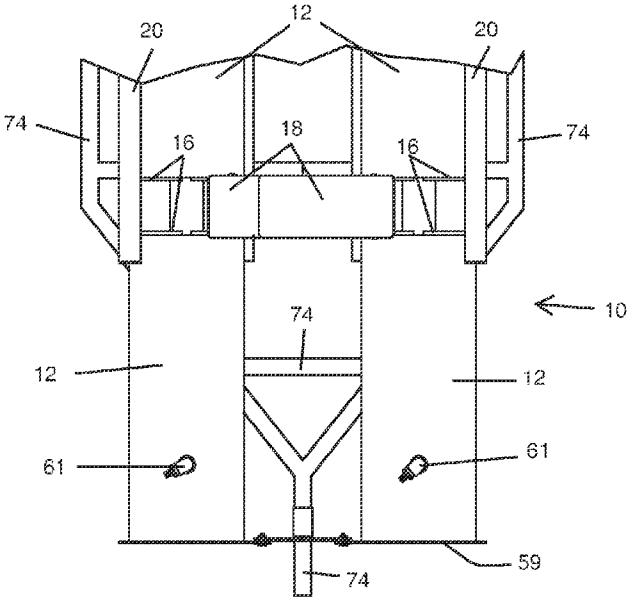
FIG. 18A is a partial top view illustrating how the elevated dock can be transported using a boat trailer.
Figure 18B:
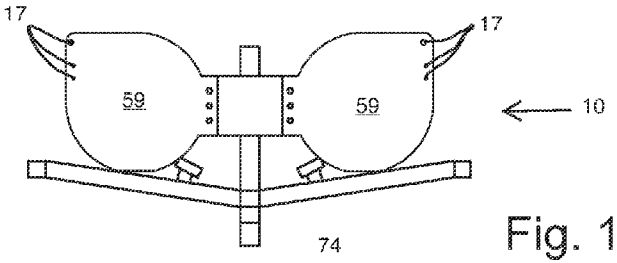
FIG. 18B is a front partial elevation view illustrating how the elevated dock can be transported using a boat trailer frame.

The transport of the elevated dock 10 can be easily accomplished by placing the elevated dock 10 on a typical boat trailer 74. FIGS. 18A and 18B show two views of how the elevated dock 10 can be transported using a boat trailer 74.

While specific embodiments and applications of the present invention have been illustrated and described, it is to be understood that the invention is not limited to the precise configuration and components disclosed herein. Various modifications, combinations of features, changes, and variations which will be apparent to those skilled in the art may be made in the arrangement, operation, and details of the methods and structure of the present invention disclosed herein without departing from the spirit and scope of the invention.

What is claimed is:

1. An elevated dock for lifting and securing a boat above water level, comprising:

at least two non-parallel pontoons positioned spaced from each other by one or more lateral struts, each pontoon having a substantially circular transverse shape;

at least one flat plate gusset fitting around the substantially circular transverse shape of each pontoon and configured to have at least one anchoring hole, each lateral strut connected to at least one of the flat plate gussets;

at least one support plate pivotally connected to at least one anchoring hole of one of the flat plate gussets at a pivot elevated from the pontoons;

at least one bumper connected to at least one of the flat plate gussets and elevated from the pontoons; and an exhaust port for each pontoon for permitting entrance and exit of water from the interior of the pontoon, wherein each of the pontoons has a rear gusset with a slot that limits the positioning of an exhaust port.

2. An elevated dock of claim 1 wherein the pontoons are telescoping.

3. An elevated dock of claim 1 wherein the pontoons and the flat plate gussets are comprised of polymeric material.

4. An elevated dock of claim 1 wherein the at least one anchoring hole comprises a plurality of pin holes in at least one of the flat plate gussets for adjustably positioning a pinned connection for pivotally supporting at least one of the support plates.

5. An elevated dock of claim 1 further comprising at least one stabilizer secured to at least one of the pontoons.

6. An elevated dock of claim 1 further comprising at least one positive stop.

7. An elevated dock of claim 1 further comprising at least one adjustable slide rail attached to at least one of the pontoons.

8. An elevated dock of claim 1 further comprising an articulation hinge to facilitate the articulation of at least a portion of at least one of the pontoons.

9. An elevated dock of claim 1 further comprising a buoyant sealed pontoon disposed at the front of the elevated dock for holding at least a portion of the front of the elevated dock above water level while permitting the rear of the elevated dock to sink below water level.

10. An elevated dock of claim 1 further comprising a sea anchor.

11. A lightweight elevated dock for lifting and securing a boat above water level, comprising:

at least two non-parallel, polymeric pontoons positioned spaced from each other by one or more lateral struts, each pontoon having a substantially circular transverse shape;

at least one polymeric flat plate gusset fitting around the substantially circular transverse shape of each pontoon and configured to have at least one anchoring hole, each lateral strut connected to at least one of the flat plate gussets;

at least one support plate pivotally connected to at least one anchoring hole of one of the flat plate gussets at a pivot elevated from the pontoons;

at least one exhaust port for each pontoon for permitting entrance and exit of water from the interior of the pontoon; and at least one pneumatic coupler for each pontoon for permitting entrance of pressurized air into the interior of the pontoon; and wherein each of the pontoons has a rear gusset with a slot that limits the positioning of the exhaust port.

12. An elevated dock of claim 11 wherein the pontoons are length-adjustable.

13. An elevated dock of claim 11 wherein at least one lateral strut is length-adjustable.

14. An elevated dock of claim 11 wherein the at least one exhaust port has an adjustable elbow to facilitate the positioning of the exhaust port.

15. An elevated dock of claim 14 wherein the adjustable elbow has a vertical adjustment collar permitting the vertical adjustment of the exhaust port.

16. An elevated dock of claim 14 wherein the adjustment elbow has a rotational adjustment collar permitting the rotational adjustment of the exhaust port.

17. An elevated dock of claim 11 further comprising an articulation hinge to facilitate the articulation of at least a portion of at least one of the pontoons.

18. An elevated dock of claim 11 further comprising a buoyant sealed pontoon disposed at the front of the elevated dock for holding at least a portion of the front of the elevated dock above water level while permitting the rear of the elevated dock to sink below water level.

19. An elevated dock of claim 11 further comprising a sea anchor.

* * * * *